US011239588B2

(12) United States Patent
Wu et al.

(10) Patent No.: US 11,239,588 B2
(45) Date of Patent: Feb. 1, 2022

(54) CARD EDGE CONNECTOR WITH IMPROVED ENGAGEMENT OF GROUND CONTACTS AND GROUND PLATE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Kui Wu, Kunshan (CN); Xiao-Hu Yin, Huaian (CN); Guo-Xiang Niu, Huaian (CN); Wen-Jun Tang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/857,656

(22) Filed: Apr. 24, 2020

(65) Prior Publication Data

US 2020/0343661 A1 Oct. 29, 2020

(30) Foreign Application Priority Data

Apr. 24, 2019 (CN) ..... 201910334435.2

(51) Int. Cl.
*H01R 12/72* (2011.01)
*H01R 13/11* (2006.01)

(52) U.S. Cl.
CPC ..... *H01R 12/721* (2013.01); *H01R 13/11* (2013.01)

(58) Field of Classification Search
CPC ..... H01R 12/721; H01R 13/11
USPC ..... 439/386
See application file for complete search history.

(56) References Cited

U.S. PATENT DOCUMENTS 4,428,635 A * 1/1984 Hamsher, Jr. ..... H01R 12/89 29/832
4,718,867 A * 1/1988 Seidel ..... H01R 13/6582 439/607.17
5,035,631 A * 7/1991 Piorunneck ..... H01R 13/6582 439/108
5,137,454 A * 8/1992 Baechtle ..... H01R 12/57 439/267
5,372,518 A * 12/1994 Liu ..... H01R 12/7005 439/326
5,425,658 A * 6/1995 White ..... H01R 12/721 439/637

(Continued)

*Primary Examiner* — Peter G Leigh
(74) *Attorney, Agent, or Firm* — Ming Chieh Chang; Wei Te Chung

(57) ABSTRACT

A card edge connector includes an elongated housing comprising opposite long walls and defining a card slot between the long walls, two rows of contacts retained in the long walls respectively and a ground member including two long plates retained in the long walls respectively. Each row of contacts includes ground contacts and signal contacts, the ground contacts comprises retaining sections retained in the housing, elastic sections extending upward from the retained sections with mating portions exposed to the card slot and leg sections extending downward from the retaining sections. Each of the ground contacts further comprises an engaging portion curved from the elastic section and touching corresponding long plate.

20 Claims, 9 Drawing Sheets

(56) References Cited

U.S. PATENT DOCUMENTS 5,496,180 A * 3/1996 Fabian ..... H01R 4/028 439/60
5,634,819 A * 6/1997 Pan ..... H01R 12/721 439/637
5,800,213 A * 9/1998 Regnier ..... H01R 12/721 439/637
5,830,017 A * 11/1998 Owsley ..... H01R 12/721 439/637
5,957,708 A * 9/1999 Lin ..... H01R 12/7005 439/157
6,019,616 A * 2/2000 Yagi ..... H01R 13/6582 439/108
6,206,706 B1 * 3/2001 Lee ..... H01R 12/716 439/637
6,739,884 B2 * 5/2004 Vicich ..... H01R 13/658 439/108
6,832,933 B2 * 12/2004 Bu ..... H01R 12/721 439/637
6,890,193 B2 * 5/2005 Kimura ..... H01R 23/6873 439/108
6,929,510 B2 * 8/2005 Pan ..... H01R 13/6582 439/607.31
6,942,524 B2 * 9/2005 Wu ..... H01R 12/716 439/62
7,066,743 B2 * 6/2006 Hu ..... H01R 13/424 439/83
7,210,955 B2 * 5/2007 Ringler ..... H01R 12/585 439/381
7,578,701 B2 * 8/2009 Hsu ..... H01R 13/6594 439/607.34
7,637,783 B2 * 12/2009 Sasaoka ..... H01R 43/16 439/637
7,771,232 B2 * 8/2010 Si ..... H01R 13/658 439/607.01
7,896,661 B2 * 3/2011 Yao ..... H01R 12/721 439/83
8,113,863 B2 * 2/2012 Vrenna ..... H01R 12/721 439/327
8,221,139 B2 * 7/2012 Qin ..... H01R 31/08 439/92
8,449,335 B2 * 5/2013 Briant ..... H01R 12/7005 439/637
8,900,001 B2 * 12/2014 Li ..... H01R 12/7005 439/157
8,936,488 B2 * 1/2015 Bahali ..... H01R 12/721 439/637
9,022,809 B2 * 5/2015 Tang ..... H01R 12/721 439/637
9,048,581 B2 * 6/2015 Briant ..... H01R 13/4361
9,196,986 B2 * 11/2015 Tanaka ..... H01R 12/737
9,385,453 B2 * 7/2016 Yang ..... H05K 7/1409
9,608,349 B2 * 3/2017 Mashiyama ..... H01R 13/2457
9,935,385 B2 * 4/2018 Phillips ..... H01R 13/516
9,966,679 B2 * 5/2018 Xu ..... H01R 12/737
9,972,945 B1 * 5/2018 Huang ..... H01R 13/6585
10,355,428 B2 * 7/2019 Fang ..... H01R 12/721
10,581,206 B2 3/2020 Fang et al.
10,826,211 B2 * 11/2020 Wang ..... H01R 13/15
2005/0101190 A1 * 5/2005 Ong ..... H01R 43/0256 439/637
2005/0282437 A1 * 12/2005 Fan ..... H01R 13/4538 439/607.05
2017/0033508 A1 * 2/2017 Hsu ..... H01R 13/629
2018/0054009 A1 * 2/2018 Wang ..... H01R 12/721
2020/0076131 A1 * 3/2020 Hu ..... H01R 13/6597

* cited by examiner

CARD EDGE CONNECTOR WITH IMPROVED ENGAGEMENT OF GROUND CONTACTS AND GROUND PLATE

BACKGROUND OF THE INVENTION

1. Field of the Invention

The present invention relates generally to a card edge connector, and more particularly to a card edge connector having an engagement of ground contacts and a ground plate.

2. Description of Related Arts

U.S. Ser. No. 10/581,206B discloses a card edge connector which includes an insulating housing, contacts ad a ground member retained in the housing. The ground member includes two ground plates, each long plate defines a plurality of elastic fingers from an upper edge thereof and pressing against the ground plate. It can be seen that the distance between the ground contacts and the ground plate is limited to be small, the length of the finger is limited and the top arc portions of the fingers can be easily damaged.

An improved card edge connector is desired.

SUMMARY OF THE INVENTION

An object of the invention is to provide a card edge connector, the connector comprises an elongated housing comprising opposite long walls and defining a card slot between the long walls, two rows of contacts retained in the long walls respectively and a ground member comprising two long plates retained in the long walls respectively. Each row of contacts comprises ground contacts and signal contacts. The ground contacts comprise retaining sections retained in the housing, elastic sections extending upward from the retained sections with mating portions exposed to the card slot and leg sections extending downward from the retaining sections. Each of the ground contacts further comprises an engaging portion curved from the elastic section and touching corresponding long plate.

DETAILED DESCRIPTION OF THE PREFERRED EMBODIMENT

Figure 1:
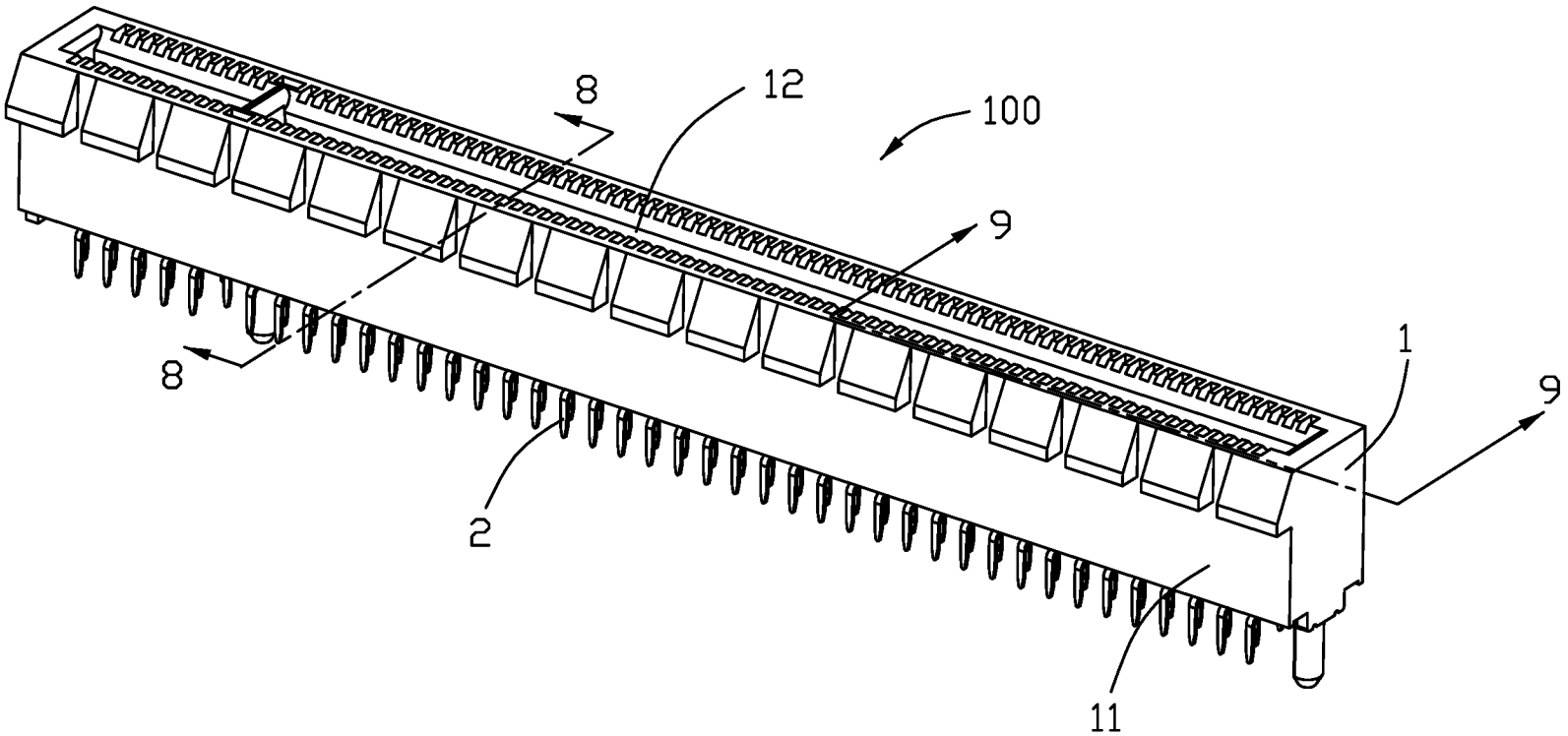
FIG. 1 is a perspective view of a card edge connector according to a preferred embodiment of the invention.

Referring to FIGS. 1-9, an embodiment of this present invention is a card edge connector 100, which includes an elongate housing 1 made from insulating material, conductive contacts 2 retained in the housing 1 and a ground member 3. The housing 1 defines two opposite long/side walls 11 with a card (receiving) slot 12 between the long walls 11 and two opposite short/end walls 13 and a bottom wall 14 connecting with the long walls 11 and short walls 13. The contacts 2 are arranged in two rows and each include ground contacts 21 and signal contacts 22. In this embodiment, these two kinds of contacts have a same construction. The ground contact 21 includes a retaining section 23 retained in the housing, an elastic section 24 extending upward and with an arc mating portion or contacting section 241 extending into the card slot 12, and a leg section 25 extending downward and out the housing. The ground contact 21 further defines an engaging portion 26 for engagement with the ground member 3, the engaging portion 26 is curved from the elastic section 24.

Figure 3:
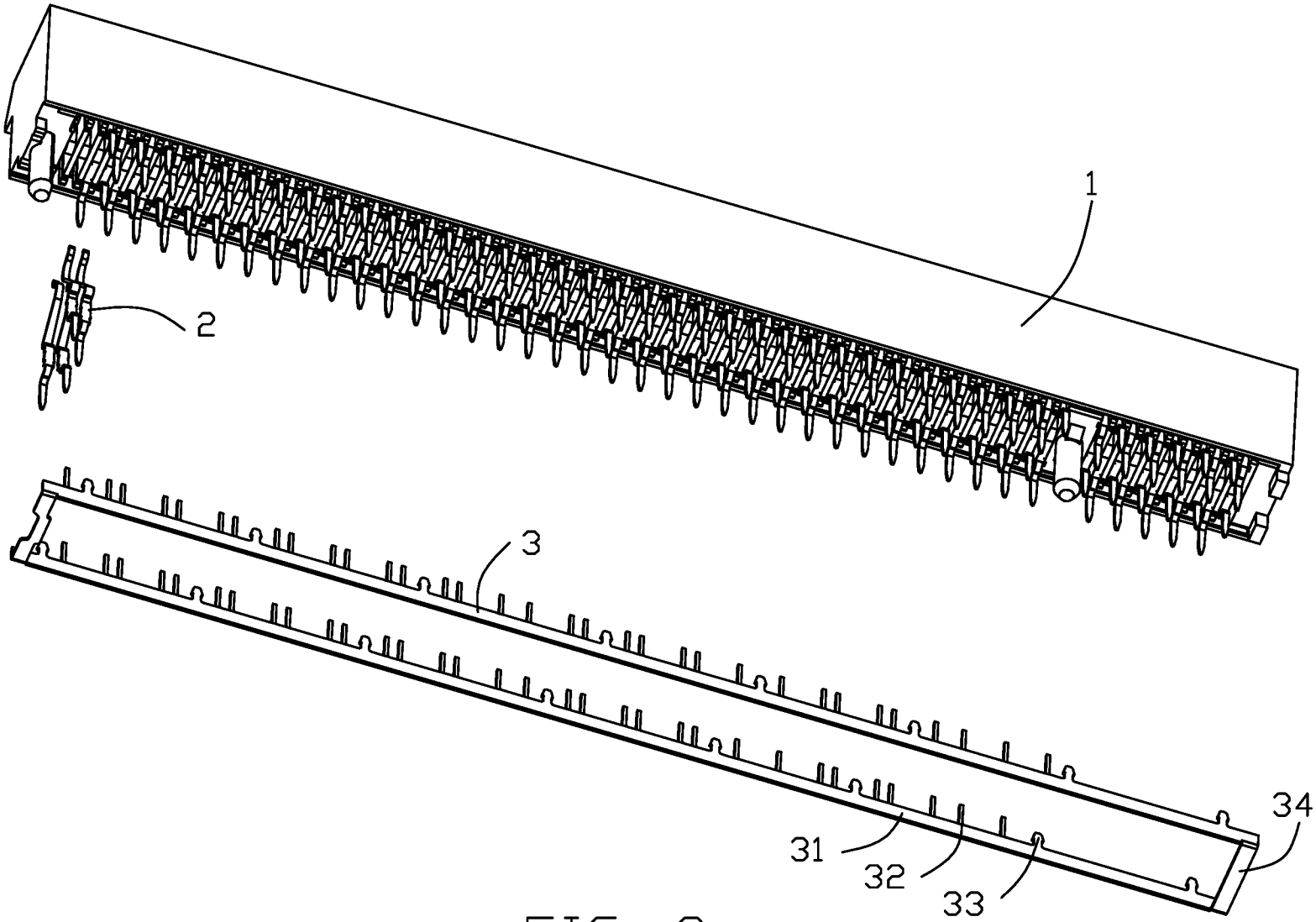
FIG. 3 is an exploded perspective view of the card edge connector in FIG. 2.
Figure 5:
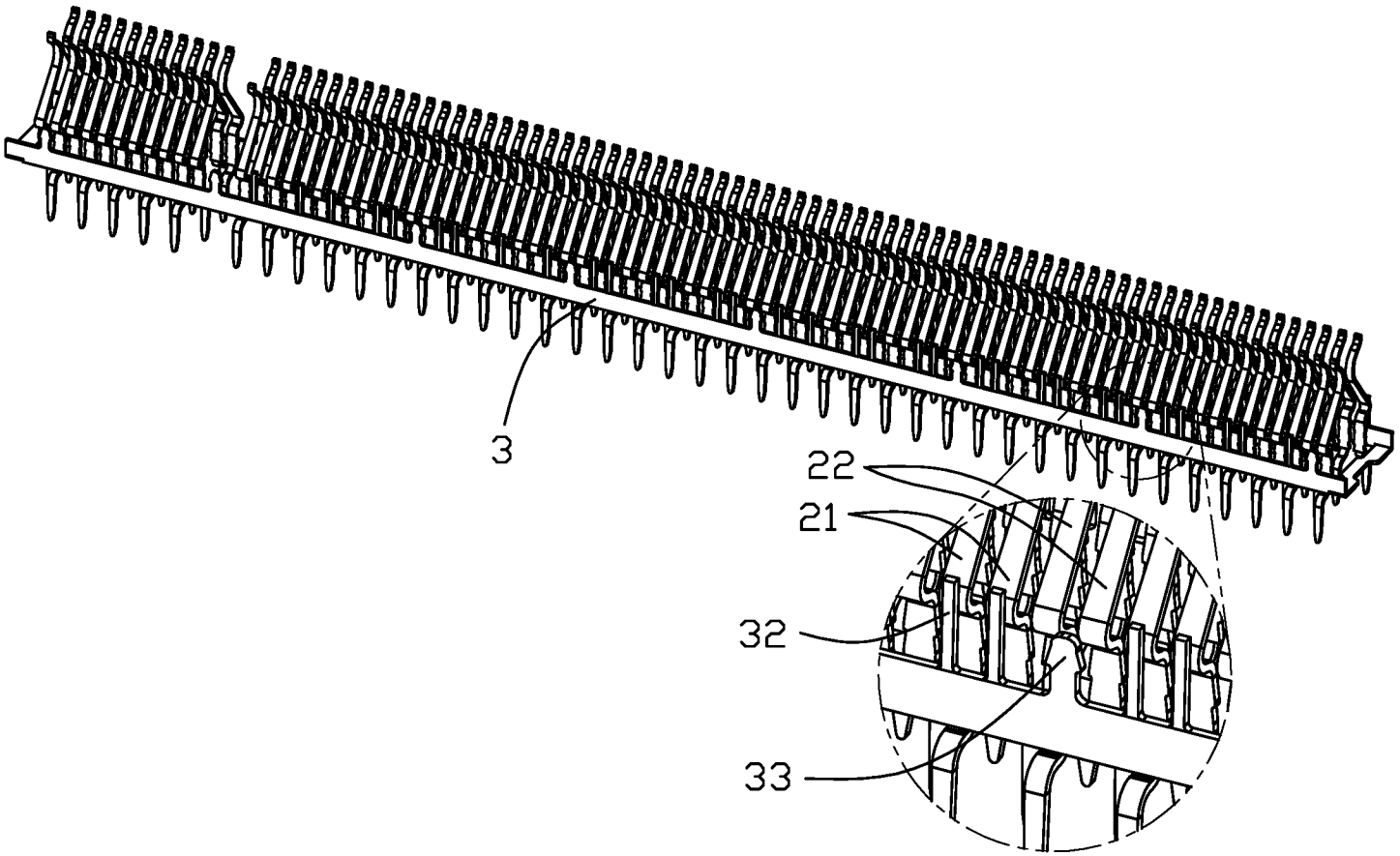
FIG. 5 is an exploded perspective view of contacts and ground member in FIG. 1.

Referring to FIGS. 3 and 5, the ground member 3 includes two long/ground plates/bars 31 retained in long walls respectively and a plurality of upright sections 32 extending from an upper edge of each long wall 31. The engaging portions 26 press against the upright sections 32 one by one. The ground member 3 further defines at least one retaining ribs 33 upwards from the upper edge of the long wall 31, and the retaining ribs 33 are interfered with the long wall 11. The width of the upright section 32 in an elongate direction are smaller than that of the retaining section 33, while a height of the upright section 32 is larger than that of the retaining section 33 in an upright direction. Understandingly, the engaging portions 26 are arc and the upright sections 32 are linear, so that the ground member 3 is simple compared with the traditional grounding member requisitely forming deflectable spring tangs engaged with the corresponding grounding contacts.

The elastic sections 24 include the engaging portions 26 slanting outward from the retaining sections 23, linear portions 242 slanting inwards from the engaging portions 26 and the mating portions 21 extending from the linear portions 241. The upper end of each engaging portion 26 unitarily connects the lower end of the elastic section 24 and the lower end of each engaging portion 26 connects the upper end of the retaining section 23. The engaging portion 26 extends from the upper edge of the retaining section 23 and slants towards the long plate 31. From a top view, the engaging portions 26 and the elastic sections 24 are located at opposite sides of the retaining sections 23. The arc shape engaging portion 26 lengthens the contact, thereby enhancing deformation performance of the ground contacts. The elastic sections 24 will be pushed outwards in a transverse direction when a card is inserted in the card slot 11, and cause an outward force of the engaging portions 26 to enhance an engagement between the engaging portions 26 and the upright sections 32. Pressing points of the engaging portions 26 and the long plates 31 also function as pivot points of the elastic sections 24 rotating outwards when the card is inserted in the card slot 11.

Figure 4:
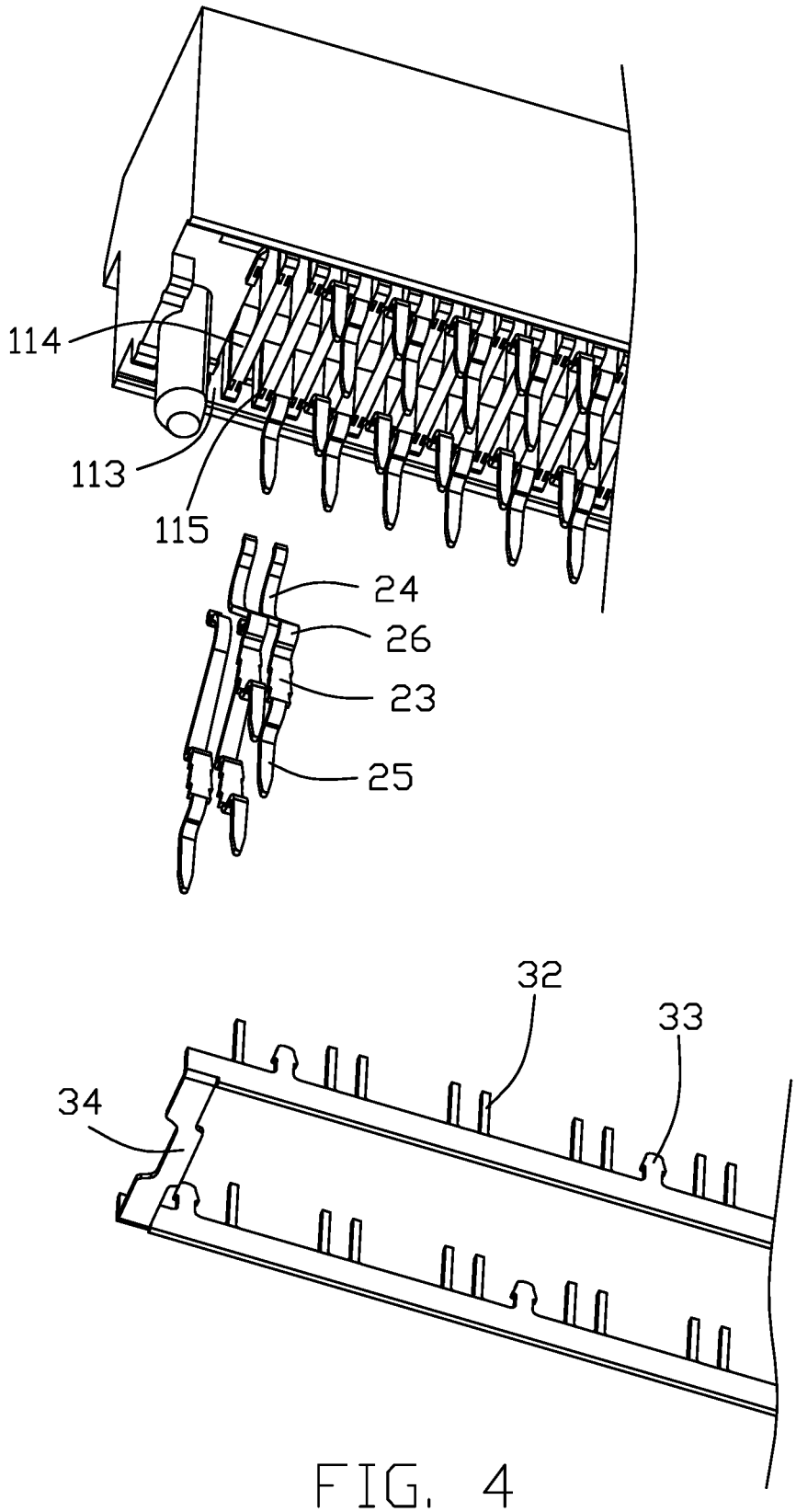
FIG. 4 is an enlarged exploded perspective of parts of the card edge connector of FIG. 3.
Figure 8:
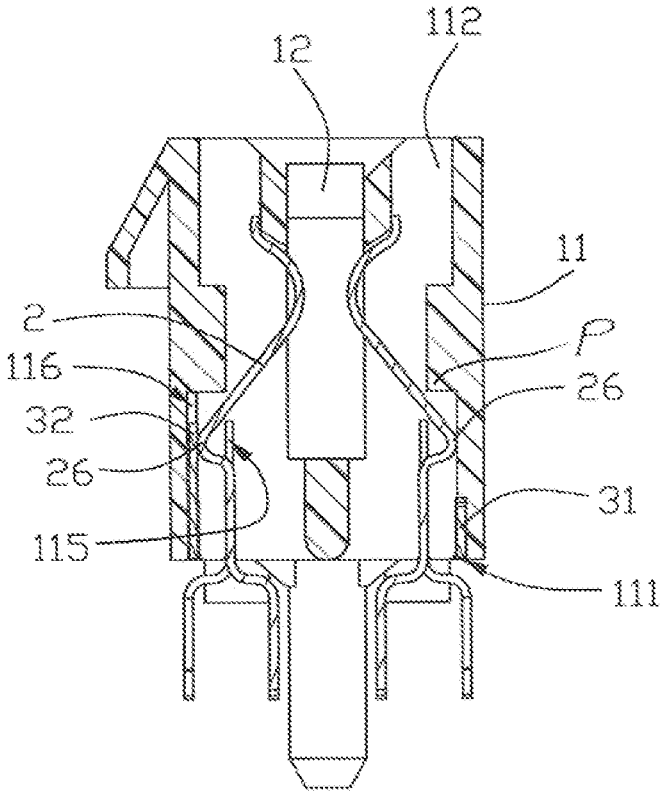
FIG. 8 is a sectional view of the card edge connector FIG. 1 taken broken lines 8-8.
Figure 9:
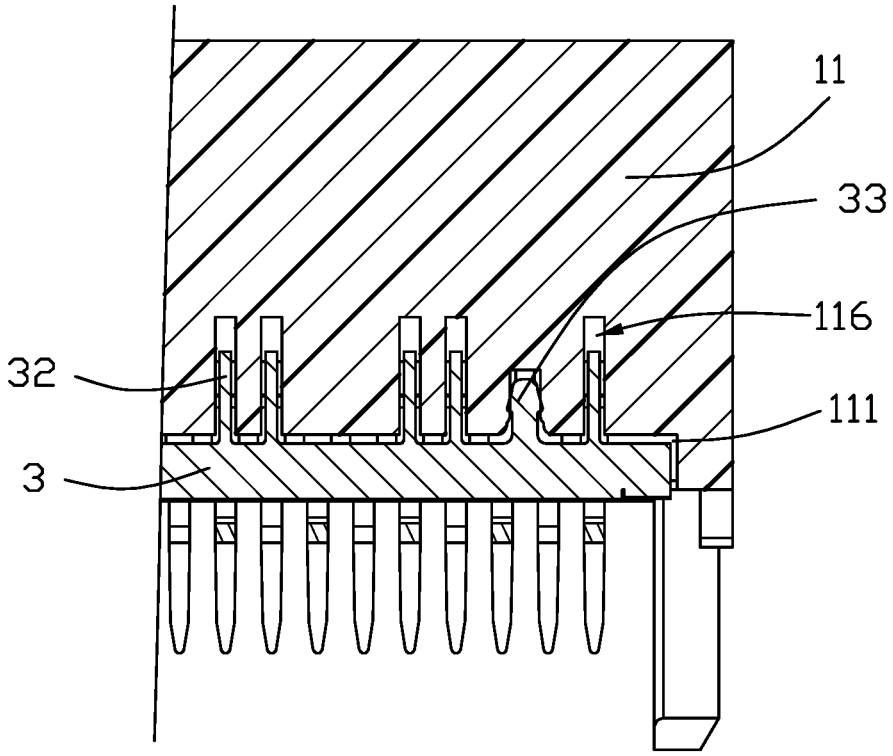
FIG. 9 is a sectional view of parts of the card edge connector FIG. 1 taken broken lines 9-9.

Referring to FIGS. 8-9, each of the long walls 11 defines a receiving slot 111, and the long plate 31 is inserted in the receiving slot 111. The retaining sections 33 are located between but disconnect with two adjacent contacts 2 as best shown in FIG. 5. The long walls 11 define grooves/passageways 112 and the contacts 2 are received in the grooves 112. Each groove 112 defines side face 113 extending along the elongated direction and the upright direction, and two end faces 114 extending along the transverse direction and the upright direction as best shown in FIG. 4. The retaining sections 23 are retained in slots 115 defined on end faces 114 and separate from the side face 113. The housing 1 further forms a plurality of slits 116 communicatively aligned with the receiving slot 111 to receive the corresponding upright sections 32, respectively. The long wall 11 forms a plurality of protrusions in the corresponding grooves 112 wherein the elastic section 24 may abut against the protrusion at position P (FIG. 8) when the card is inserted within the card slot 12 so as to reinforce the reaction of the contact during mating.

Figure 6:
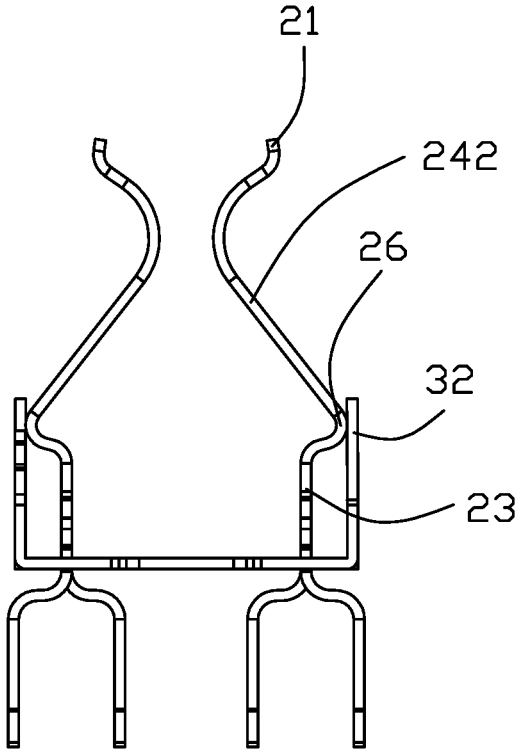
FIG. 6 is a side view of the contacts and the ground member in FIG. 5.
Figure 7:
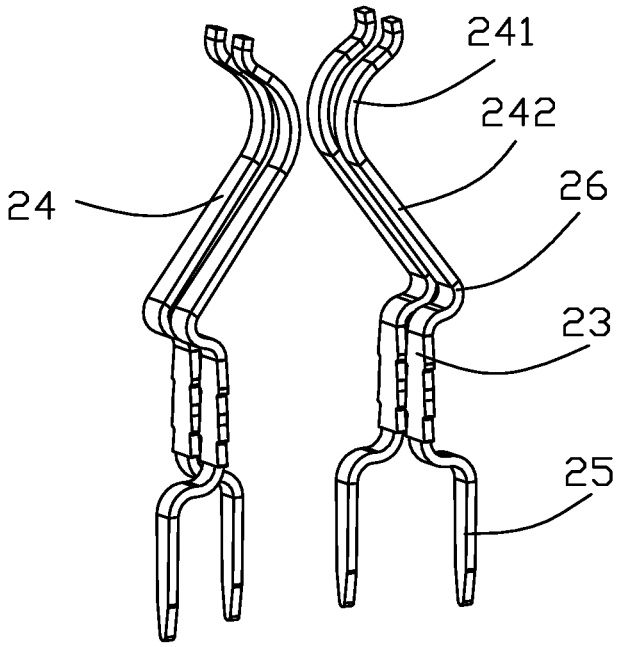
FIG. 7 is a perspective view of four contacts in FIG. 5.

In this embodiment, the signal contacts 22 and the ground contacts 21 share a same construct, that is the signal contacts also have engaging portions 26. Referring to FIG. 5, the ground member 3 defined no upright sections 32 so that the engaging portions 26 of signal contacts 221 directly abut against the corresponding side faces 113. Referring to FIG. 6, a pair of ground contacts 21 and a pair of differential signal contacts 22 are arranged alternately, and the long plates 31 defines no upright sections aligned with the engaging portions 26 of the signal contacts 22. Alternately, the signal contacts may be construed without any engaging portions, that is the linear portions 241 direct from the retaining sections 23.

Figure 2:
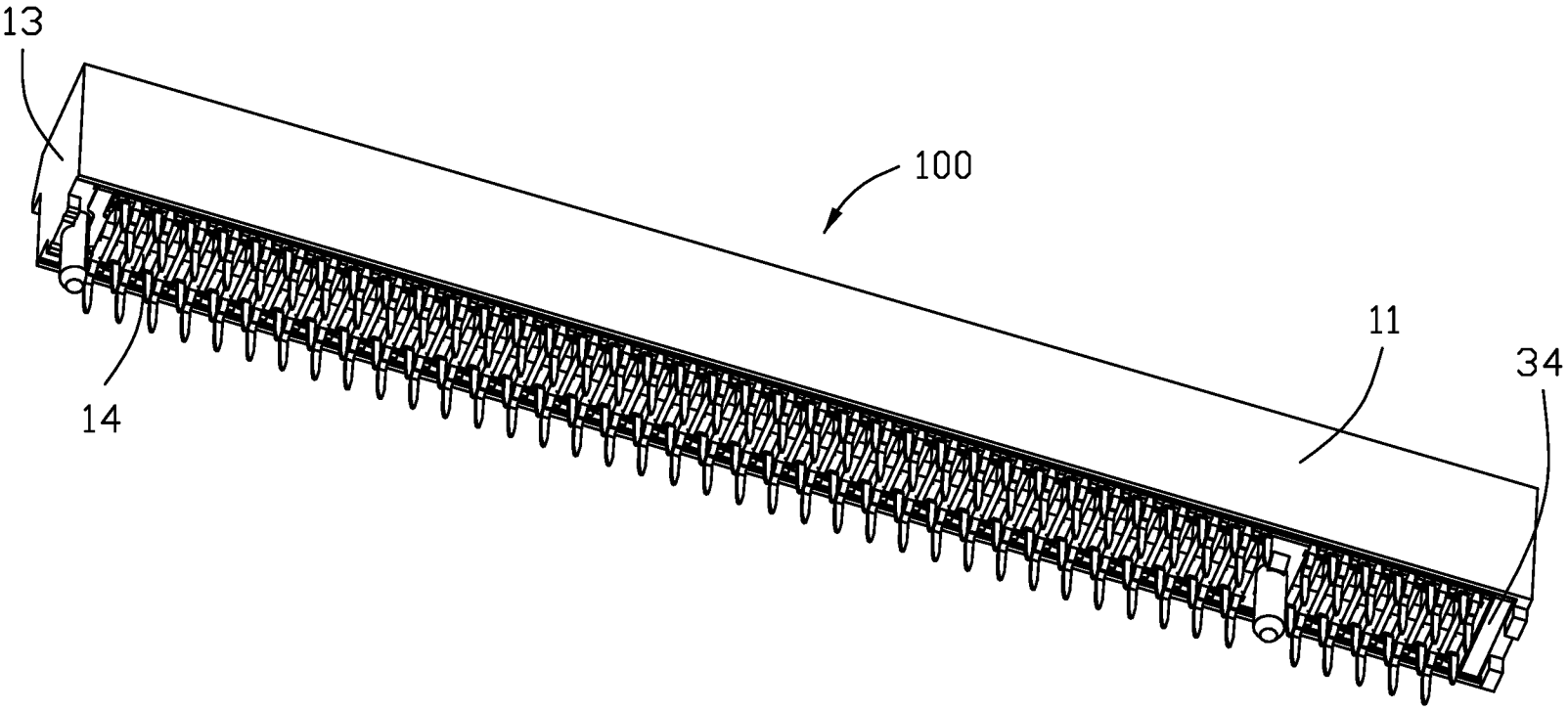
FIG. 2 is another perspective view of the card edge connector in FIG. 1.

Referring to FIGS. 2 and 4, the two long plates 31 connect with two short plates 34 at opposite ends thereof. The short plates are attached on the bottom of the housing 1.

However, the disclosure is illustrative only, changes may be made in detail, especially in matter of shape, size, and arrangement of parts within the principles of the invention.

What is claimed is:

1. A card edge connector comprising:

an elongated housing comprising opposite long walls and defining a card slot between the long walls;

two rows of contacts retained in the long walls respectively and each row of contacts comprising ground contacts and signal contacts, the ground contacts comprising retaining sections retained in the housing, elastic sections extending upward from the retaining sections with mating portions exposed to the card slot, and leg sections extending downward from the retaining sections;

a ground member comprising two long plates retained in the long walls respectively;

wherein each of the ground contacts further comprises an engaging portion curved from the elastic section, slanting outward from the retaining section toward a corresponding long plate, and touching the corresponding long plate.

2. The card edge connector as claimed in claim 1, wherein each long plate defines a plurality of upright sections extending from an upper edge thereof and contacting with corresponding engaging sections of the ground contacts.

3. The card edge connector as claimed in claim 2, wherein each long plate defines at least one retaining rib extending from the upper edge thereof and retained in the long wall.

4. The card edge connector as claimed in claim 3, wherein the upright sections extend upward beyond the at least one retaining rib.

5. The card edge connector as claimed in claim 3, wherein the at least one retaining rib is located between two adjacent contacts along a transverse direction perpendicular to the long walls.

6. The card edge connector as claimed in claim 1, wherein the elastic sections continuously extend from the engaging portions.

7. The card edge connector as claimed in claim 1, wherein the elastic portion comprises a linear portion extending from the engaging portion and the mating portion, the mating portion extending from the linear portion.

8. The card edge connector as claimed in claim 1, wherein each long wall defines a receiving slot opening downward and the long plate is received in the receiving slot from a bottom thereof.

9. A card edge connector comprising:

an insulating housing comprising opposite long walls and defining a card slot between the long walls;

at least one row of contacts retained in the long wall and the row of contacts comprising ground contacts and signal contacts, the ground contacts comprising retaining sections retained in the housing, elastic sections extending upward from the retaining sections with mating portions exposed to the card slot, and leg sections extending downward from the retaining sections;

at least one ground plate retained in the long wall;

wherein the elastic section includes an engaging portion slanting outward from the retaining section, and the engaging portions press against the ground plate and provide pivot points of the elastic sections rotating outward when a module is inserted in the card slot.

10. The card edge connector as claimed in claim 9, wherein the elastic section includes a linear section slanting inwards from the engaging portion, the mating portion extending from the linear section, and the engaging portions of the ground contacts press against the ground plate so as to provide said pivot point.

11. The card edge connector as claimed in claim 10, wherein the ground plate defines a plurality of upright sections from an upper edge thereof to engage with corresponding engaging portions of the ground contacts.

12. The card edgeconnector edge connector as claimed in claim 11, wherein the ground plate defines at least one retaining rib extending from the upper edge thereof and retained in the long wall.

13. A card edge connector for use with a memory module, comprising:

an elongated insulative housing including a pair of side walls extending along a longitudinal direction, and a pair of end walls linked between two opposite ends of said pair of side walls and extending in a transverse direction perpendicular to the longitudinal direction;

a card receiving slot formed among the pair of side walls and the pair of end walls for receiving the memory module;

two rows of passageways formed within the pair of side walls and communicating with the card receiving slot in the transverse direction;

two rows of contacts retained in the corresponding passageways, respectively, said contacts including grounding contacts and differential pair signal contacts alternately arranged with each other in the longitudinal direction and having similar configurations with each other, each contact including an immovable retaining section and a deflectable contacting section extending into the card receiving slot with a curved engaging portion therebetween;

a pair of grounding members retained in the housing, each of said grounding members forming a planar immoveable configuration in the housing and including a long bar extending continuously along and having a similar length with the corresponding side wall; and the engaging portion of each grounding contact electrically and mechanically connect to the grounding member while the engaging portion of each signal contact abuts against the housing.

14. The card edge connector as claimed in claim 13, wherein a plurality of immovable upright sections unitarily extend upwardly from the corresponding long bar in a vertical direction perpendicular to both the longitudinal direction and the transverse direction so as to mechanically and electrically connect to the engaging portions of the corresponding grounding contacts, respectively.

15. The card edge connector as claimed in claim 14, wherein each side wall forms a receiving slot to receive the corresponding long bar, and a plurality of slits to receive the corresponding upright sections, respectively.

16. The card edge connector as claimed in claim 15, wherein each side wall forms a plurality of protrusions in the corresponding passageways, and the contacting section is outwardly deflected to abut against the corresponding protrusion when the memory module is received within the card receiving slot.

17. The card edge connector as claimed in claim 16, wherein the grounding members, the contacts and the housing are arranged to have the grounding members upwardly assembled into the housing before the contacts are upwardly assembled into the corresponding passageways, respectively.

18. The card edge connector as claimed in claim 13, wherein a width of the upright section is smaller than that of the engaging portion in the longitudinal direction.

19. The card edge connector as claimed in claim 13, wherein in each contact, viewed along a vertical direction perpendicular to both the longitudinal direction and the transverse direction, the contacting section and the engaging portion are located at opposite side of the retaining section in the transverse direction.

20. The card edge connector as claimed in claim 19, wherein the contacting section is higher than the engaging portion in the vertical direction.

* * * * *